US008205607B1

(12) United States Patent
Darlington

(10) Patent No.: US 8,205,607 B1
(45) Date of Patent: Jun. 26, 2012

(54) COMPOUND ARCHERY BOW

(75) Inventor: Rex F. Darlington, Whittemore, MI (US)

(73) Assignee: Darton, Inc., Hale, MI (US)

( * ) Notice: Subject to any disclaimer, the term of this patent is extended or adjusted under 35 U.S.C. 154(b) by 260 days.

(21) Appl. No.: 12/459,316

(22) Filed: Jun. 30, 2009

(51) Int. Cl.
*F41B 5/10* (2006.01)

(52) U.S. Cl. ..... 124/25.6; 124/23.1; 124/86; 124/90

(58) Field of Classification Search ..... 124/23.1, 124/25.6, 900, 90, 86
See application file for complete search history.

(56) References Cited

U.S. PATENT DOCUMENTS

| | | | | |
|---|---|---|---|---|
| 4,519,374 | A * | 5/1985 | Miller | 124/25.6 |
| 4,774,927 | A * | 10/1988 | Larson | 124/25.6 |
| 4,838,236 | A * | 6/1989 | Kudlacek | 124/25.6 |
| 5,934,265 | A * | 8/1999 | Darlington | 124/25.6 |
| 6,082,347 | A * | 7/2000 | Darlington | 124/25.6 |
| 6,237,582 | B1 * | 5/2001 | McPherson | 124/25.6 |
| 6,250,293 | B1 * | 6/2001 | Andrews | 124/25.6 |
| 6,516,790 | B1 * | 2/2003 | Darlington | 124/25.6 |
| 6,691,692 | B1 * | 2/2004 | Adkins | 124/25.6 |
| 6,871,643 | B2 * | 3/2005 | Cooper et al. | 124/25.6 |
| 6,990,970 | B1 * | 1/2006 | Darlington | 124/25.6 |
| 6,994,079 | B1 * | 2/2006 | Darlington | 124/25.6 |
| 7,082,937 | B1 * | 8/2006 | Land | 124/25.6 |
| 7,188,615 | B2 * | 3/2007 | Chang | 124/25.6 |
| 7,305,979 | B1 * | 12/2007 | Yehle | 124/25.6 |
| 7,690,372 | B2 * | 4/2010 | Cooper et al. | 124/25.6 |
| 7,721,721 | B1 * | 5/2010 | Kronengold et al. | 124/25.6 |
| 7,770,568 | B1 * | 8/2010 | Yehle | 124/25.6 |
| 8,006,679 | B2 * | 8/2011 | Strother | 124/25.6 |
| 2004/0074485 | A1 * | 4/2004 | Cooper et al. | 124/25.6 |
| 2005/0193998 | A1 * | 9/2005 | Cooper et al. | 124/25.6 |
| 2010/0051005 | A1 * | 3/2010 | Wilson | 124/25.6 |
| 2010/0147276 | A1 * | 6/2010 | Wilson et al. | 124/25.6 |

* cited by examiner

*Primary Examiner* — Gene Kim
*Assistant Examiner* — Alexander Niconovich
(74) *Attorney, Agent, or Firm* — Reising Ethington PC

(57) ABSTRACT

A compound archery bow includes a handle having projecting limbs, and first and second pulleys mounted on the limbs for rotation around respective axes. First and second cable anchors are disposed on the base adjacent to respective ends of a cable groove. A bow cable arrangement includes a bowstring cable extending from a bowstring anchor on the first pulley around a bowstring let-out groove and then toward the second pulley. A first cable extends from the first anchor on the first pulley through a portion of the cable groove on the first pulley and then toward the second pulley. A second cable extends from the second anchor toward the second pulley. Draw of the bowstring cable way from the bow handle lets out bowstring cable from the bowstring let-out groove on the first pulley and rotates the first pulley around its axis, lets out the first cable from the cable groove on the first pulley and takes up the second cable into the cable groove on the first pulley including a portion of such groove previously occupied by the first cable. The first pulley includes a hub surrounding the first axis and a removable draw module having an edge extending from the hub toward said second anchor. The cable groove extends along the edge of the draw module and the hub between the first and second anchors.

6 Claims, 5 Drawing Sheets

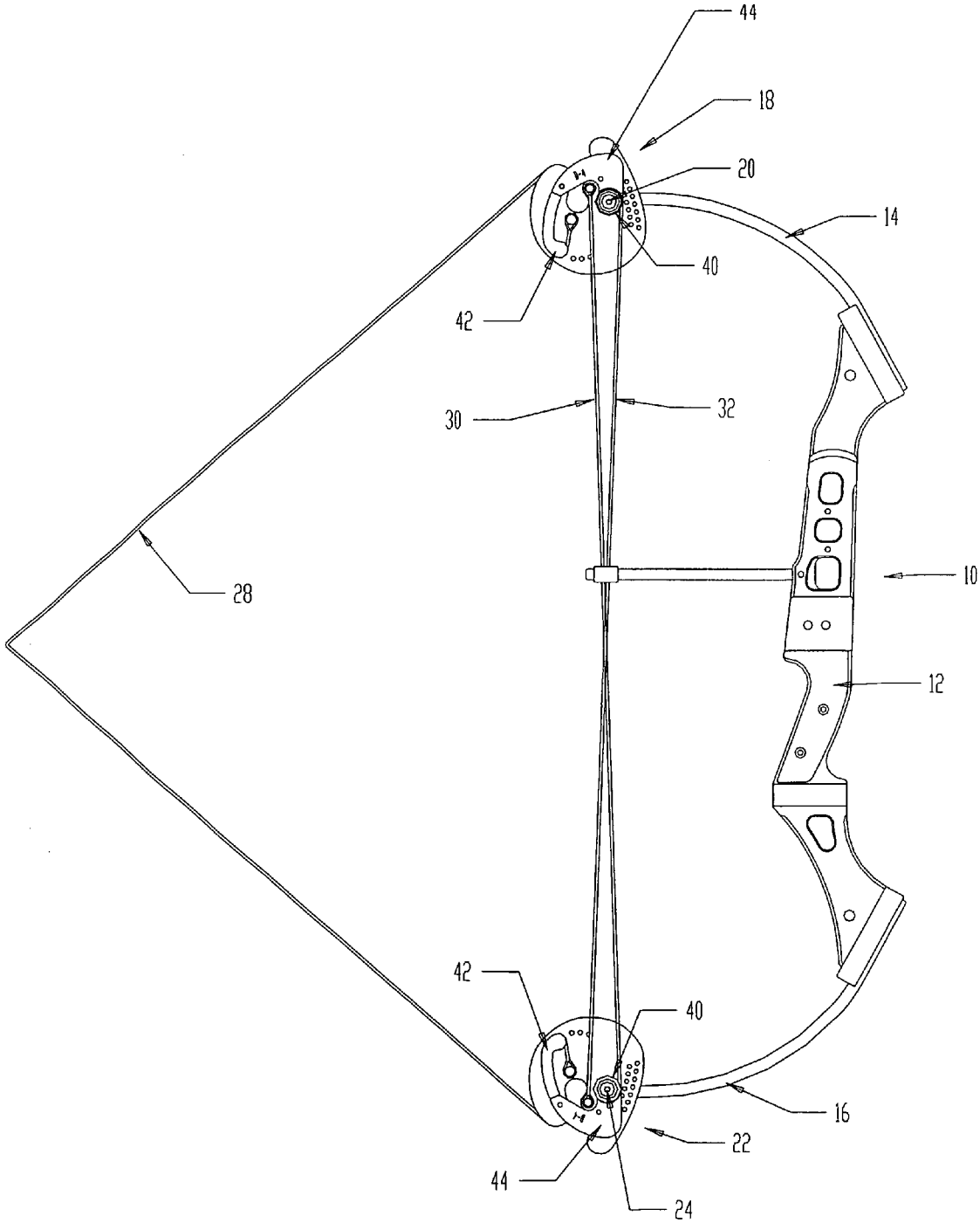
Fig.1-A

COMPOUND ARCHERY BOW

The present disclosure relates to compound archery bows having pulleys at the ends of the bow limbs to control the force/draw characteristics of the bow, and more particularly to compound archery bows having a draw length module removably mounted on at least one of the pulleys for adjusting bow draw length.

BACKGROUND AND SUMMARY OF THE DISCLOSURE

Single-cam and dual-cam compound archery bows have a power cam mounted on one or both ends of the bow limbs to control the draw force on the bowstring and the bending of the limbs as the bowstring is drawn. In single-cam bows, there is a power cam on the end of one bow limb, and a wheel on the end of the other bow limb to facilitate let-out of the bowstring as the bow is drawn. In dual-cam bows, power cams are mounted on the ends of both limbs, with each including groove segments to control let-out of the bowstring cable on the opposing cam. The power cam or cams may include a draw length control module adjustably or removably mounted on the power cam for adjusting the draw length of the bow. More recently there have been Hybrid cam systems that incorporate a mixture of both systems; there is a power cam on the end of one bow limb, and a wheel on the end of the other bow limb to facilitate control or time take-up of the power cable at the power cam and let-out of the bowstring and control cables at the power cam as the bow is drawn.

A general object of the present disclosure is to provide a compound archery bow of the described type that achieves enhanced power and arrow speed as compared with compound archery bows of the prior art, and/or reduces or eliminates timing issues between cams on dual-cam bows, and/or in which the draw length module can be replaced for adjusting draw length without disassembling the power cam or the bow.

The present disclosure embodies a number of aspects that can be implemented separately from or in combination with each other.

A compound archery bow, in accordance with one aspect of the present disclosure, includes a handle having projecting limbs, and first and second pulleys mounted on the limbs for rotation around respective axes. At least a first of the pulleys includes a flat base with a bowstring let-out groove and a bowstring anchor adjacent to the bowstring let-out groove. A cable groove is provided on the first pulley, and first and second cable anchors are disposed on the base adjacent to respective ends of the cable groove. The cable groove is substantially continuous in a plane perpendicular to the axis of the first pulley. A bow cable arrangement includes a bowstring cable extending from the bowstring anchor on the first pulley around the bowstring let-out groove and then toward the second pulley. A first cable extends from the first anchor on the first pulley through a portion of the cable groove on the first pulley and then toward the second pulley. A second cable extends from the second anchor toward the second pulley. Draw of the bowstring cable way from the bow handle lets out bowstring cable from the bowstring let-out groove on the first pulley and rotates the first pulley around its axis, lets out the first cable from the cable groove on the first pulley and takes up the second cable into the cable groove on the first pulley including a portion of such groove previously occupied by the first cable. The first pulley includes a hub surrounding the first axis and a removable draw module having an edge extending from the hub toward the second anchor. The cable groove extends along the edge of the draw module and the hub between the first and second anchors.

BRIEF DESCRIPTION OF THE DRAWINGS

The disclosure, together with additional objects, features, advantages and aspects thereof, will best be understood from the following description, the appended claims and the accompanying drawings, in which:

FIG. 1A is an elevational view of the bow in FIG. 1 with the bowstring cable fully drawn;

DETAILED DESCRIPTION OF PREFERRED EMBODIMENTS

The disclosure of U.S. application Ser. No. 12/290,750 filed Nov. 3, 2008 is incorporated herein by reference.

Figure 1:
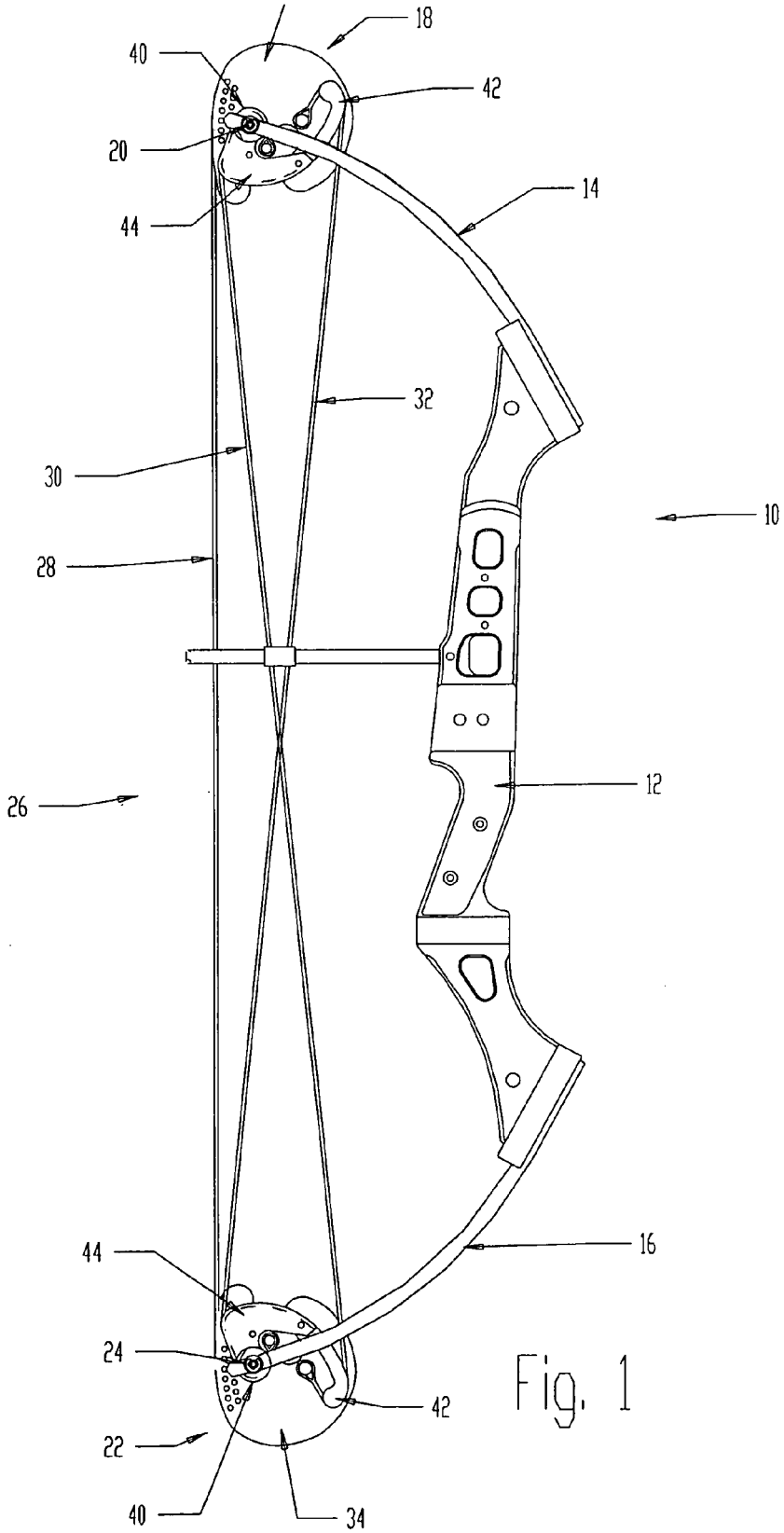
FIG. 1 is an elevational view of a compound archery bow in accordance with an exemplary embodiment of the present disclosure.

FIG. 1 illustrates a dual-cam compound archery bow 10 in accordance with an exemplary embodiment of the present disclosure as including a handle 12 of aluminum or other relatively rigid construction having spaced risers with bow-limb mounting surfaces at each end. A pair of flexible resilient limbs 14, 16 of fiber-reinforced resin or other suitable resilient construction are mounted on the respective handle risers and project away from handle 12. An upper pulley 18 is mounted on limb 14 for rotation around an axle 20, and a lower pulley 22 is mounted on limb 16 for rotation around an axle 24. Pulleys 18, 22 are similar in function and preferably are near mirror images of each other. Upper pulley 18 can be slightly larger than lower pulley 22 to compensate for the arrow rest not being at the true center of the bow. The pulleys also can be made non-identical in areas that are non-functional to create a desired difference in appearance. A bow cable arrangement 26 includes a bowstring cable 28 and a pair of power cables 30, 32 extending between pulleys 18, 22.

Figure 2:
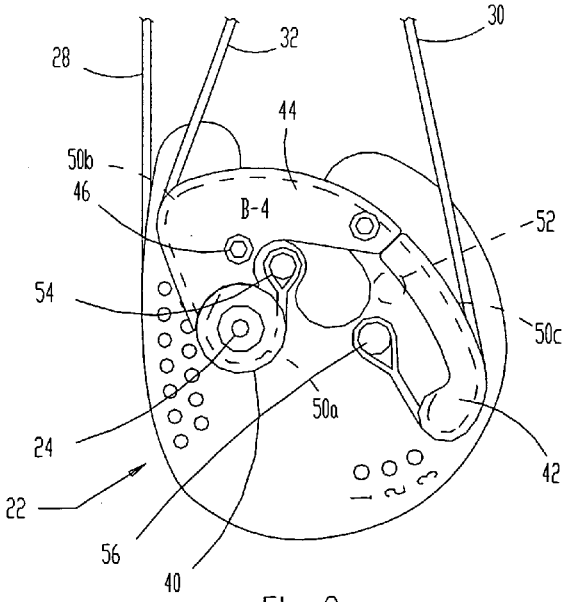
FIG. 2 is a fragmentary elevational view on an enlarged scale of the pulleys in the bow of FIG. 1.

Upper pulley 18 in FIG. 2 includes a flat base 34 having an outer peripheral edge 36 in which a bowstring let-out groove 38 is disposed. A hub 40 is mounted on base 34 surrounding an opening for receiving axle 20. A section 42 is secured to base 34 at a position spaced from hub 40. A draw length module 44 is removably mounted on base 34, such as by screws 46, and has an edge 48 that extends between hub 40 and section 42. A cable groove is formed by a first groove section 50*a* extending around at least a portion of the periphery of hub 40, second portion 50*b* extending along edge 48 of module 44, and a third portion 50*c* extending along an edge of section 42. Cable groove 50*a*, 50*b*, 50*c* preferably is substantially continuous in a plane perpendicular to the axis of rotation around axle 20, "substantially" meaning that there are no more than small gaps between the cable groove sections that do not affect smooth drawing of the bow.

In the undrawn condition of the bow (FIGS. 1 and 2), bowstring cable 28 extends around bowstring let-out groove 38 to a bowstring cable anchor 52 adjacent to the end of the bowstring let-out groove. Power cable 30 extends from an anchor 54 on base 34 adjacent to an end of groove section 50*a* through groove section 50*a* on hub 40, through a portion of groove section 50*b* on module 44 and thence toward pulley 22. Power cable 32 extends from an anchor 56 on base 34 through at least a portion of cable groove section 50*c* and thence toward pulley 22. Lower pulley 22 is essentially a mirror image of pulley 18, and corresponding elements in FIG. 2 are identified by correspondingly identical reference numerals. (It will be will be appreciated that the terms "upper" and "lower" are employed for descriptive purposes only with respect to the orientation of FIGS. 1-2.)

As bowstring cable 28 is drawn from the rest position of FIGS. 1 and 2 toward the fully drawn position of FIG. 1A, the bowstring cable is withdrawn from the bowstring let-out grooves 38 on the upper and lower pulleys, upper pulley 18 is rotated counterclockwise in FIGS. 1 and 2, and lower pulley 22 is rotated clockwise, around the respective axles 20, 24. Power cable 30 is let out from cable groove sections 50*b* and then 50*a* on pulley 18 while being taken up in groove section 50*c*, then groove section 50*b* and then groove section 50*a* on pulley 22. At the same time, power cable 32 is taken up into cable groove section 50*c*, then cable groove section 50*b* and then groove section 50*a* on pulley 18 while being let out of groove section 50*b* and then section 50*a* on pulley 22. Thus, as the bow is drawn, power cable 32 occupies portions of cable groove 50*a*, 50*b*, 50*c* previously occupied by control cable 30 in pulley 18, and vice versa in pulley 22. At the fully drawn position of FIG. 1A, cable 30 extends from anchor 54 on pulley 18 through groove section 50*a*, 50*b*, 50*c* to anchor 56 on pulley 22, while cable 32 extends from anchor 54 on pulley 22 through groove section 50*a*, 50*b*, 50*c* to anchor 56 on pulley 18. Power cables 30, 32 extend around hubs 40, which preferably are circular or oval, and which are designed so that the cable grooves 50*b* on the various modules will match and align correctly when installed.

Figure 3D:
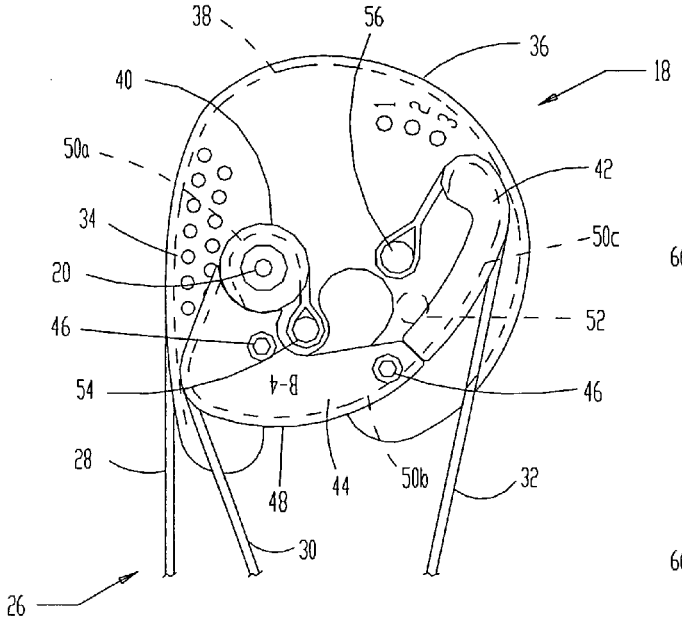
FIGS. 3A-3D are elevational views of respective replaceable draw length modules for the bow of FIGS. 1-2.
Figure 3D:
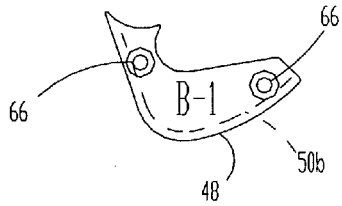
Figure 3C:
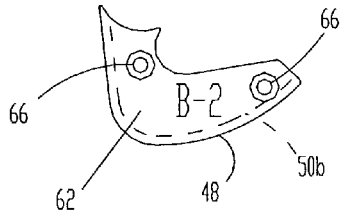
Figure 3B:
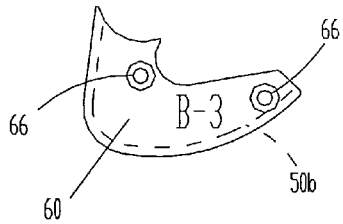
Figure 3A:
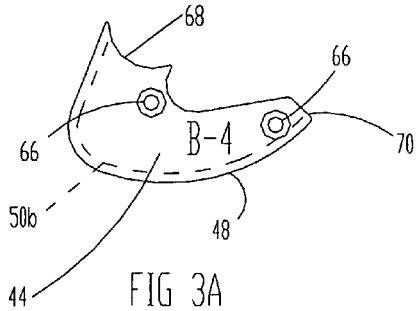

FIG. 3A illustrates replaceable draw length module 44 of FIG. 2, while FIGS. 3B-3D illustrate draw length modules 60, 62, 64 for imparting progressively decreasing draw length to the bow. Module 44 has openings 66 for receiving screws 46 (FIG. 2) to mount the draw length module on base 34 as previously described. Module 34 may be generally J-shaped, having a short leg with a pocket 68, which may be part-circular, at one end for nesting around a portion of the periphery of hub 40, which may be circular or oval. The opposing end of the module has a face 70 for engagement with an opposing face of fixed section 42. Face 70 may be flat. Modules 60, 62, 64 are of generally similar geometry but with peripheral edges 48 of progressively decreasing lengths so that cable groove sections 50*b* likewise are of progressively decreasing length. It will be noted in FIG. 2 that modules 48 can be replaced by an associated pair of modules 60 or 62 or 64 to adjust the draw length of the bow without having to disassemble the cam or the bow. A bow 10 can be marketed with modules 44 in place, for example, and with modules 60, 62, 64 separately provided with instructions for mounting the modules and with the bow draw length associated with each module.

Modules 60, 62, 64 may be of any suitable shape determined by the draw cycle desired. Groove section 50*b* preferably is smooth and arcuate, without any abrupt steps or discontinuations that would affect the "feel" of the bow as it is drawn.

Figure 4C:
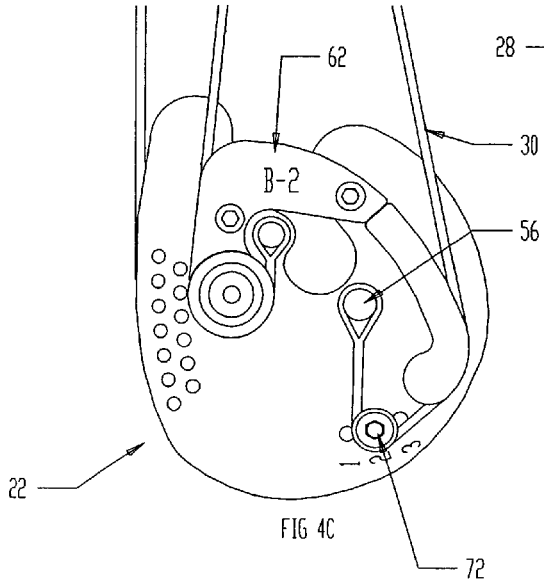
FIGS. 4A-4D are elevational views of the lower pulley in FIG. 2 with the various draw length modules of FIG. 3A assembled to the pulley.
Figure 4A:
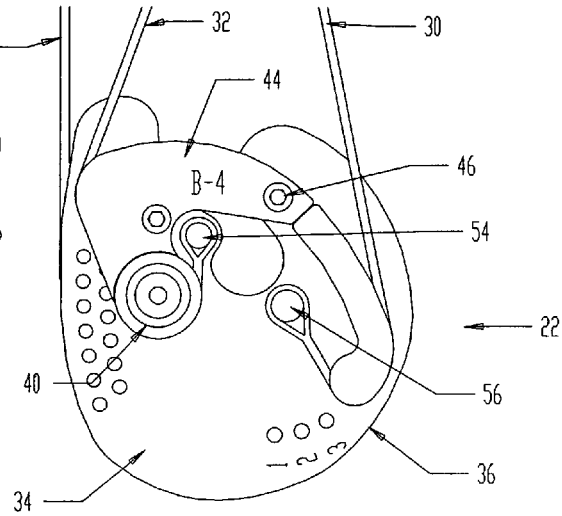
Figure 4D:
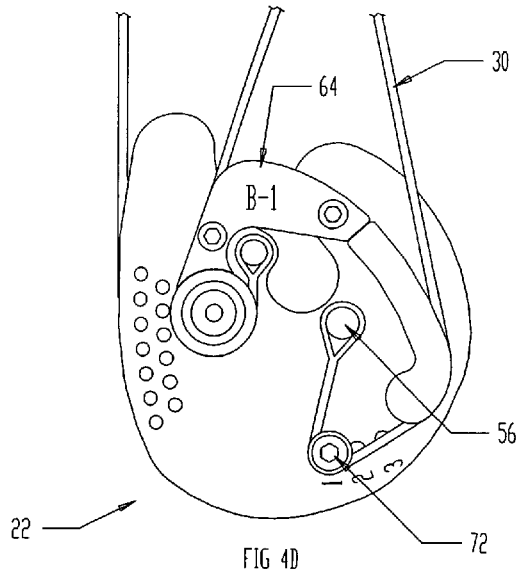
Figure 4B:
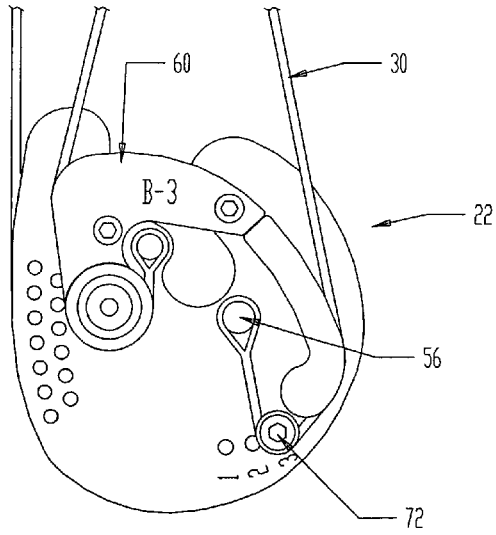

FIGS. 4A-4D illustrate lower pulley 22 with modules 44, 60, 62 and 64 respectively in place. In FIGS. 2 and 4A, power cable 30 extends at pulley 22 directly from section 42 to anchor post 56. In FIGS. 4B-4D employing modules 60, 62, 64 having shorter groove tracks, and intermediate post 72 is adjustably positionable on base 34 to adjust the effective length of power cable 30. This allows the pre-stress in the bow limbs and the distance from the handle grip to the bowstring to remain constant with the use of different draw modules.

Figures 5A, 5B, 5C:
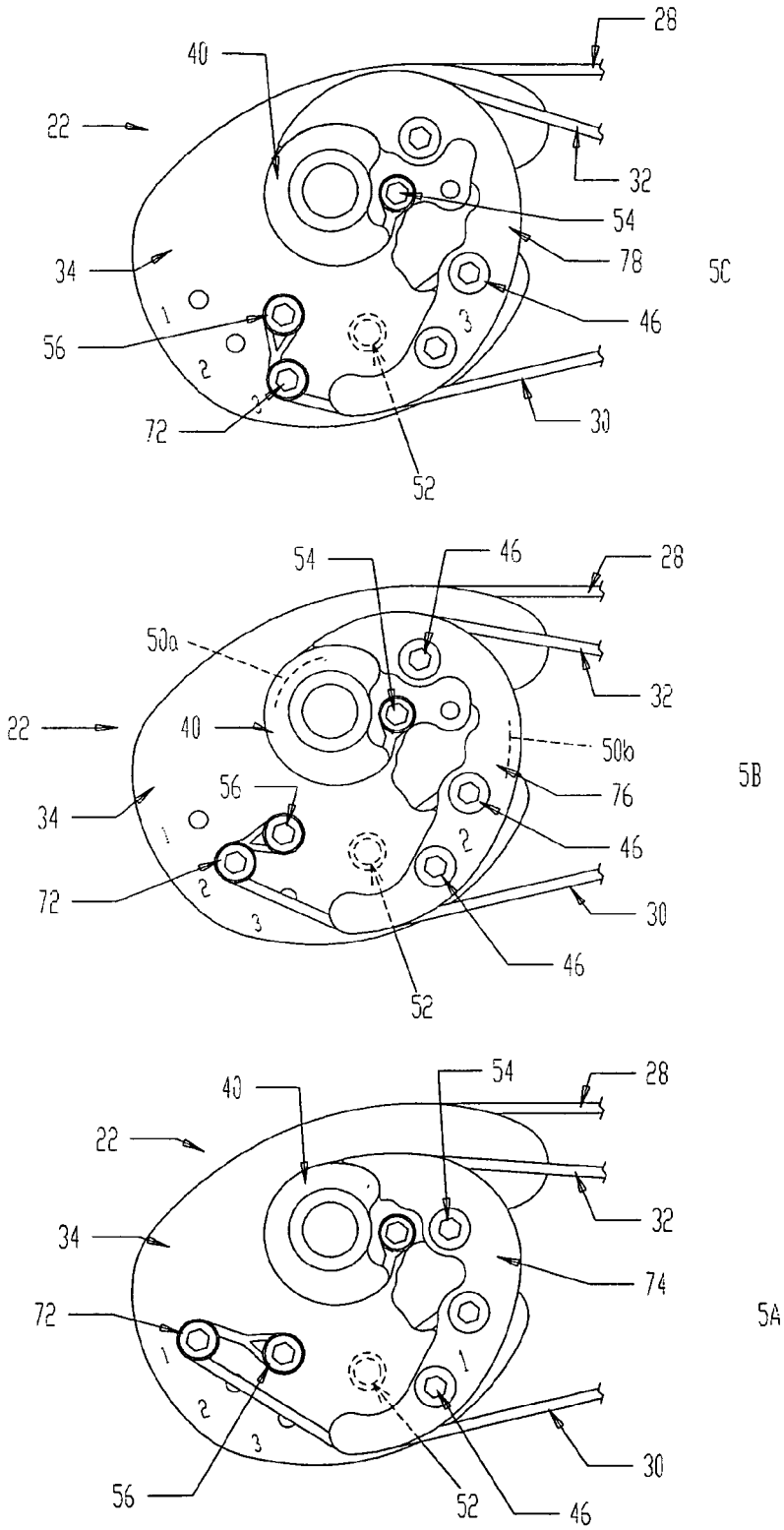
FIGS. 5A-5C are elevational views of the lower pulley in FIG. 2 with various draw length modules assembled to the pulley in accordance with a further embodiment of the disclosure.

FIGS. 5A-5C illustrate lower pulleys 22 having respective replaceable arcuate draw modules 74, 76 and 78. Each replaceable module 74-78 is selectively mountable on base 34, and has a peripheral groove 50*b* that extends from hub 40 toward anchor 56. As in the embodiment of FIGS. 4A-4D, an intermediate post 72 is selectively and adjustably positionable between the edge of module 74 (or 76 or 78) and anchor 56 to adjust the effective length of cable 30. This allows the pre-stress in the bow limbs and the distance between the bow handle and the bowstring to remain constant with the use of different draw modules 74-78. The draw length modules thus can be of any suitable generally arcuate configuration such as J-shaped, part-oval, crescent-shaped, etc. It also will be understood that, whereas FIGS. 5A-5C illustrate lower pulley 22, the construction of the upper pulley preferably would be substantially a mirror image of FIGS. 5A-5C in a dual-cam bow.

There thus has been disclosed a compound archery bow that fully satisfies all of the objects and aims previously set forth. The bow has been disclosed in conjunction with an exemplary embodiment, and various modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A compound archery bow that includes:

a bow handle having projecting limbs, a first pulley mounted on a first of said limbs for rotation around a first axis, a second pulley mounted on a second of said limbs for rotation around a second axis, at least said first pulley including a flat base, a bowstring let-out groove on said base, a bowstring anchor adjacent to said bowstring let-out groove, a cable groove on said base that is substantially continuous in a plane perpendicular to said first axis, a first cable anchor adjacent to one end of said cable groove and a second cable anchor adjacent to a second end of said cable groove, and a bow cable arrangement including a bowstring cable extending from said bowstring anchor through said bowstring let-out groove on said first pulley and then toward said second pulley, a first cable extending from said first anchor through a portion of said cable groove on said module and then toward said second pulley, and a second cable extending from said second anchor toward said second pulley, wherein draw of said bowstring cable away from said handle lets out bowstring cable from said bowstring let-out groove and rotates said first pulley around said first axis, lets out said first cable from said cable groove on said first pulley and takes up said second cable into at least a portion of said cable groove on said first pulley previously occupied by said first cable, characterized in that said first pulley includes a hub surrounding said first axis and a removable draw module having an edge extending from said hub toward said second anchor, said cable groove extending along said edge of said draw module and along said hub between said first and second anchors, said removable draw module including a plurality of said different draw modules individually removably mountable on said base between said hub and said second anchor for providing different draw lengths for said bowstring cable, wherein said second anchor or an intermediate post is adjustably positionable on the cam base to adjust the effective lengths of said first and second cables to maintain pre-stress in the bow limbs and maintain a constant distance between the bow handle and the bowstring with use of different draw modules.

2. The bow set forth in claim 1 wherein said first pulley includes an intermediate post removably and adjustably positioned on said base between said draw modules and said second anchor so that pre-stress in said limbs and distance between said handle and said bowstring remains constant using said plurality of different draw modules.

3. The bow set forth in claim 1 wherein said bow is a dual-cam bow with said first and second pulleys being similar in function and essentially mirror images of each other.

4. The bow set forth in claim 1 wherein said first pulley includes a fixed section spaced from said hub, and wherein said cable groove extends along said fixed section, said edge of said draw module and said hub between said first and second anchors.

5. The bow set forth in claim 1 wherein said draw-length module is arcuate having an end pocket adjacent to said hub and an end surface adjacent to said second anchor.

6. The bow set forth in claim 1 wherein said hub is circular or oval and said first cable or said second cable extends around said hub so that cable grooves in said plurality of modules all align correctly with said hubs and said fixed section when installed.

* * * * *